US010621910B2

(12) United States Patent
Ji et al.

(10) Patent No.: US 10,621,910 B2
(45) Date of Patent: Apr. 14, 2020

(54) PIXEL SENSING DEVICE AND PANEL DRIVING DEVICE

(71) Applicant: SILICON WORKS CO., LTD., Daejeon (KR)

(72) Inventors: Seung Hwan Ji, Daejeon (KR); Jung Bae Yun, Daejeon (KR); Min Young Jeong, Chungcheongbuk-do (KR); Jeung Hie Choi, Cheongju-si (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 16/095,937

(22) PCT Filed: Apr. 24, 2017

(86) PCT No.: PCT/KR2017/004317

§ 371 (c)(1),
(2) Date: Oct. 23, 2018

(87) PCT Pub. No.: WO2017/188674

PCT Pub. Date: Nov. 2, 2017

(65) Prior Publication Data

US 2019/0156738 A1 May 23, 2019

(30) Foreign Application Priority Data

Apr. 26, 2016 (KR) ..... 10-2016-0050639
Apr. 21, 2017 (KR) ..... 10-2017-0051366

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0819* (2013.01);
(Continued)

(58) Field of Classification Search
CPC ..... G09G 2320/043; G09G 3/3225; G09G 2300/0819; G09G 2300/0842;
(Continued)

(56) References Cited

U.S. PATENT DOCUMENTS 9,349,317 B2 5/2016 Kim et al.
9,583,043 B2 2/2017 Mizukoshi
(Continued)

FOREIGN PATENT DOCUMENTS

KR 10-2014-0076061 A 6/2014
KR 10-2014-0091095 A 7/2014
(Continued)

OTHER PUBLICATIONS

PCT International Search Report and Written Opinion, PCT/KR2017/004317, dated Aug. 1, 2017, 4 Pages.

*Primary Examiner* — Lixi C Simpson
(74) *Attorney, Agent, or Firm* — Fenwick & West LLP

(57) ABSTRACT

The present invention provides a pixel sensing device for sensing characteristics of pixels arranged on a display panel, processing and converting the same into valid sensing data, and transmitting the valid sensing data to an external device.

12 Claims, 10 Drawing Sheets

(52) U.S. Cl.
CPC ..... *G09G 2300/0842* (2013.01); *G09G 2310/0251* (2013.01); *G09G 2310/0262* (2013.01); *G09G 2320/0295* (2013.01); *G09G 2320/043* (2013.01); *G09G 2320/0693* (2013.01)

(58) Field of Classification Search
CPC ... G09G 2310/0251; G09G 2310/0262; G09G 2320/0295; G09G 2320/0693; G09G 3/3233
See application file for complete search history.

(56) References Cited

U.S. PATENT DOCUMENTS

| | | | | |
|---|---|---|---|---|
| 2009/0184903 | A1* | 7/2009 | Kwon | G09G 3/3225 345/80 |
| 2014/0176409 | A1 | 6/2014 | Kim et al. | |
| 2015/0179107 | A1* | 6/2015 | Kim | G09G 3/3233 345/212 |
| 2016/0078813 | A1* | 3/2016 | Mizukoshi | G09G 3/3283 345/76 |
| 2016/0117974 | A1* | 4/2016 | Back | G09G 3/3225 345/213 |
| 2017/0004765 | A1* | 1/2017 | Tani | G09G 3/3275 |
| 2017/0126999 | A1* | 5/2017 | Elikhis | H04N 5/3658 |

FOREIGN PATENT DOCUMENTS

| | | | |
|---|---|---|---|
| KR | 10-2015-0033903 | A | 4/2015 |
| KR | 10-2015-0078360 | A | 7/2015 |
| KR | 10-2016-0030652 | A | 3/2016 |

* cited by examiner

PIXEL SENSING DEVICE AND PANEL DRIVING DEVICE

CROSS REFERENCE TO RELATED APPLICATION

This application claims priority from Republic of Korea Patent Applications Nos. 10-2016-0050639, filed on Apr. 26, 2016 and 10-2017-0051366, filed on Apr. 21, 2017, which are hereby incorporated by reference in their entireties.

BACKGROUND

Field of Technology

The present disclosure relates to technology for sensing characteristics of pixels arranged on a display panel and for driving such a display panel.

Description of the Prior Art

A display device may comprise a panel driving device—for example, a driving device comprising a source driver and a timing controller—for controlling the brightness of pixels arranged on a panel. The panel driving device may determine data voltage according to image data. Further, the panel driving device may control the brightness of each pixel by supplying the determined data voltage to the pixels.

Meanwhile, even though the same data voltage is supplied to the pixels, the brightness of each pixel may be different depending on characteristics of each pixel. For example, a pixel may comprise a driving transistor and when threshold voltage of the driving transistor varies, the brightness of the corresponding pixel varies even though the same data voltage is supplied to the pixels. If the panel driving device does not reflect such characteristics of each pixel, there could be a problem that the pixels are driven at the brightness that a user does not want, and this may degrade the image quality of the display panel.

The characteristics of each pixel may vary with time or depending on the surrounding environment. However, if the panel driving device supplies data voltage without reflecting the changed characteristics of each pixel, there could be a problem of deterioration of image quality, for example, line defect.

To remedy the deterioration of image quality, the display device may further comprise a pixel sensing device for sensing characteristics of a pixel. The pixel sensing device may periodically or non-periodically check the characteristics of each pixel and transmit the same to the panel driving device. The panel driving device compensates data voltage depending on the characteristic value of each pixel transmitted from the pixel sensing device, and this may solve the problem that the image quality deteriorates in response to the change of characteristics of each pixel.

By the way, the conventional pixel sensing device transmits raw sensing data as it is generated by sensing pixels. However, such a conventional method has several problems.

Firstly, the conventional method has a problem of data loss or inefficiency of data transmission due to the discrepancy between the sensing rate and the data transmission rate.

Specifically, when the data transmission rate, indicating the number of data transmitted to the panel driving device every unit time, is lower than the sensing rate, indicating the number of raw sensing data generated every unit time, part of generated raw sensing data cannot be transmitted to the panel driving device, i.e. the data loss.

On the contrary, when the data transmission rate, indicating the number of data transmitted to the panel driving device every unit time, is higher than the sensing rate, indicating the number of raw sensing data generated every unit time, part of raw sensing data may be doubly transmitted to the panel driving device, i.e. the inefficiency of data transmission.

Secondly, according to the conventional method, since raw sensing data as it is generated is transmitted to the panel driving device, the panel driving device has a load of data post-processing of removing noises included in the raw sensing data or re-processing the raw sensing data in order to obtain necessary information only. In particular, since the number of pixels increases as the definition of display devices recently becomes higher and the number of pixel sensing devices also increases along with the increased number of pixels, one panel driving device, for example, one timing controller has to process all the raw sensing data transmitted from a plurality of pixel sensing devices. Therefore, the load of data post-processing of the panel driving device becomes larger.

SUMMARY

To this end, an aspect of the present disclosure is to provide technology for increasing the utilization of data sensed at a high-speed with regard to a pixel.

Another aspect of the present disclosure is to provide technology for remedying a problem of data loss or data transmission inefficiency due to the discrepancy between the sensing rate and the data transmission rate with regard to a pixel.

Another aspect of the present disclosure is to provide technology for reducing an operation load or a data post-processing load of a panel driving device.

In order to achieve the above-described one aspect, the present disclosure provides a pixel sensing device comprising a sensing part for sensing a pixel whose brightness is controlled in response to data voltage corresponding to image data to generate raw sensing data and storing the raw sensing data to a memory; a processing part for generating valid sensing data by processing or selecting at least one raw sensing data read from the memory; and an output part for figuring out a characteristic value of the pixel using the sensing data with regard to the pixel and transmitting at least one valid sensing data to a driving control circuit which compensates the image data applied to the pixel in response to the characteristic value of the pixel.

In such a pixel sensing device, the sensing part may generate the raw sensing data by sensing current of an organic light emitting diode included in the pixel, current of the driving transistor included in the pixel, or voltage at the contact point of the organic light emitting diode and the driving transistor.

In addition, the driving control circuit may figure out, as a characteristic value of the pixel, the threshold voltage or the mobility of the driving transistor included in the pixel using the valid sensing data.

In order to achieve the above-described another aspects, the present disclosure provides a panel driving device comprising L (L is a natural number, which is 2 or higher) pixel sensing circuits, each for sensing a pixel to generate raw sensing data and transmitting valid sensing data generated by processing or selecting at least one raw sensing data; and a driving control circuit, connected with the L pixel sensing circuits through one bus line, receiving the valid sensing data sequentially transmitted from each pixel sensing circuit through the one bus line, figuring out a characteristic value of the pixel using the valid sensing data, and compensating the image data applied to the pixel in response to the characteristic value.

As described above, the present disclosure allows increasing the utilization of data sensed at a high-speed with regard to the characteristics of pixels. Further, the present disclosure allows remedying problems of the data loss or the data transmission inefficiency due to the discrepancy between the sensing rate with regard to a pixel and the data transmission rate. Further, the present disclosure allows reducing an operation load or a data post-processing load of a device for driving pixels.

DETAILED DESCRIPTION

Figure 1:
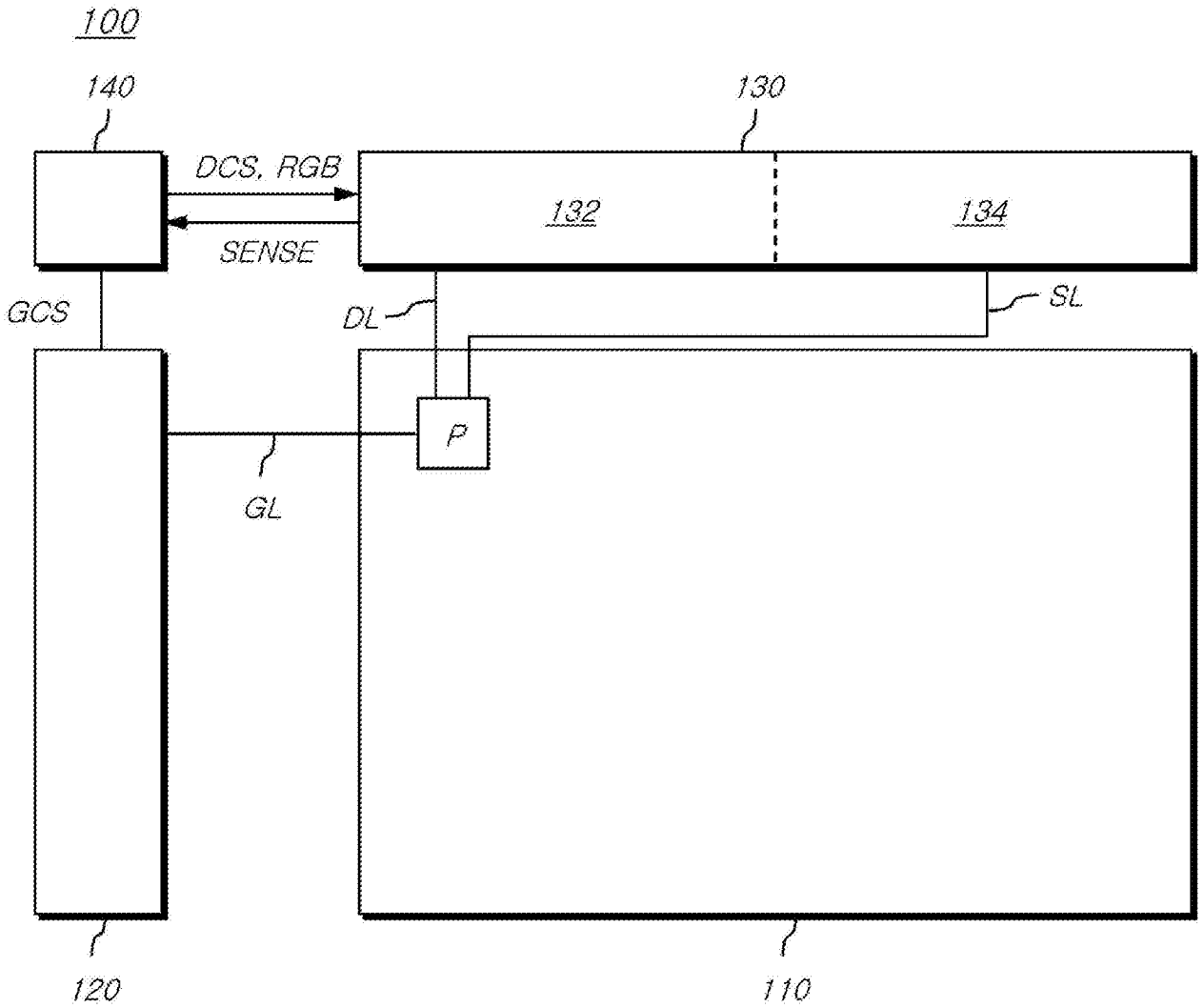
FIG. 1 is a block diagram of a display device to which an embodiment of the present disclosure.

Hereinafter, embodiments of the present disclosure will be described in detail with reference to the accompanying drawings. In adding reference numerals to elements in each drawing, the same elements will be designated by the same reference numerals as far as possible, although they are shown in different drawings. Further, in the following description of the present disclosure, a detailed description of known functions and configurations incorporated herein will be omitted when it is determined that the description may make the subject matter of the present disclosure rather unclear.

In addition, terms, such as first, second, A, B, (a), (b) or the like may be used herein when describing components of the present disclosure. These terms are merely used to distinguish one structural element from other structural elements, and a property, an order, a sequence or the like of a corresponding structural element are not limited by the term. When it is described in the specification that one component is "connected," "coupled" or "joined" to another component, it should be read that the first component may be directly connected, coupled or joined to the second component, but also a third component may be "connected," "coupled," and "joined" between the first and second components.

FIG. 1 is a block diagram of a display device to which an embodiment of the present disclosure.

Referring to FIG. 1, the display device 100 comprises a panel 110, a gate driving circuit 120, a data driving circuit 132, a pixel sensing circuit 134, and a driving control circuit 140.

On the panel 110, a plurality of data lines DL, a plurality of gate lines GL, a plurality of sensing lines SL, and a plurality of pixels P may be disposed.

The gate driving circuit 120 may supply scan signals of turn-on voltage or turn-off voltage through the gate lines GL. When such a scan signal of turn-on voltage is supplied to a pixel P, the corresponding pixel P is connected to a data line DL and when a scan signal of turn-off voltage is supplied to a pixel P, the corresponding pixel P is disconnected from the data line DL.

The gate driving circuit 120 may be called as a gate driver, but the present disclosure is not restricted to this name.

The data driving circuit 132 supplies data voltage through the data lines DL. The data voltage supplied through a data line DL may be supplied to a pixel P connected with the data line DL depending on a scan signal.

The pixel sensing circuit 134 may sense each pixel P. Specifically, the pixel sensing circuit 134 may sense an electrical characteristic value such as voltage, current, etc. formed in each pixel P. The pixel sensing circuit 134 may be connected with each pixel P according to a scan signal or connected with each pixel P according to a separate sensing signal. Here, the sensing signal may be generated by the gate driving circuit 120.

The data driving circuit 132 and the pixel sensing circuit 134 may be realized in an integrated circuit form, for example, a source driver 130. However, the present disclosure is not restricted to this.

The driving control circuit 140 may supply control signals of every kind to the gate driving circuit 120, the data driving circuit 132, and the pixel sensing circuit 130. The driving control circuit 140 may generate gate control signals GCS making scan start in response to the timing realized in each frame and transmit the same to the gate driving circuit 120. Further, the driving control circuit 140 may convert image data inputted from outside into image data RGB in conformity with a data signal form used in the data driving circuit 132 and output the image data RGB to the data driving circuit 132. In addition, the driving control circuit 140 may transmit a data control signal DCS controlling the data driving circuit 132 to supply data voltage to each pixel P with a right timing. In addition, the driving control circuit 140 may transmit a control signal (not shown) determining the sensing timing and the transmission timing of the pixel sensing circuit 134 to the pixel sensing circuit 134.

The driving control circuit 140 may compensate the image data RGB in response to the characteristics of each pixel and transmit the same. Here, the driving control circuit 140 may receive sensing data SENSE from the pixel sensing circuit 134 to figure out the characteristics of each pixel.

The driving control circuit 140 may be called as a timing controller, but the present disclosure is not restricted to this name.

The panel 110 may be an organic light emitting display panel. Here, each pixel P disposed on the panel 110 may comprise an organic light emitting diode OLED and one or more transistors. The characteristics of such an organic light emitting diode OLED and transistors may vary with time or in response to the surrounding environment and the pixel sensing circuit 134 may sense the characteristics of such elements comprised in each pixel and transmit the same to the driving control circuit 140.

Figure 2:
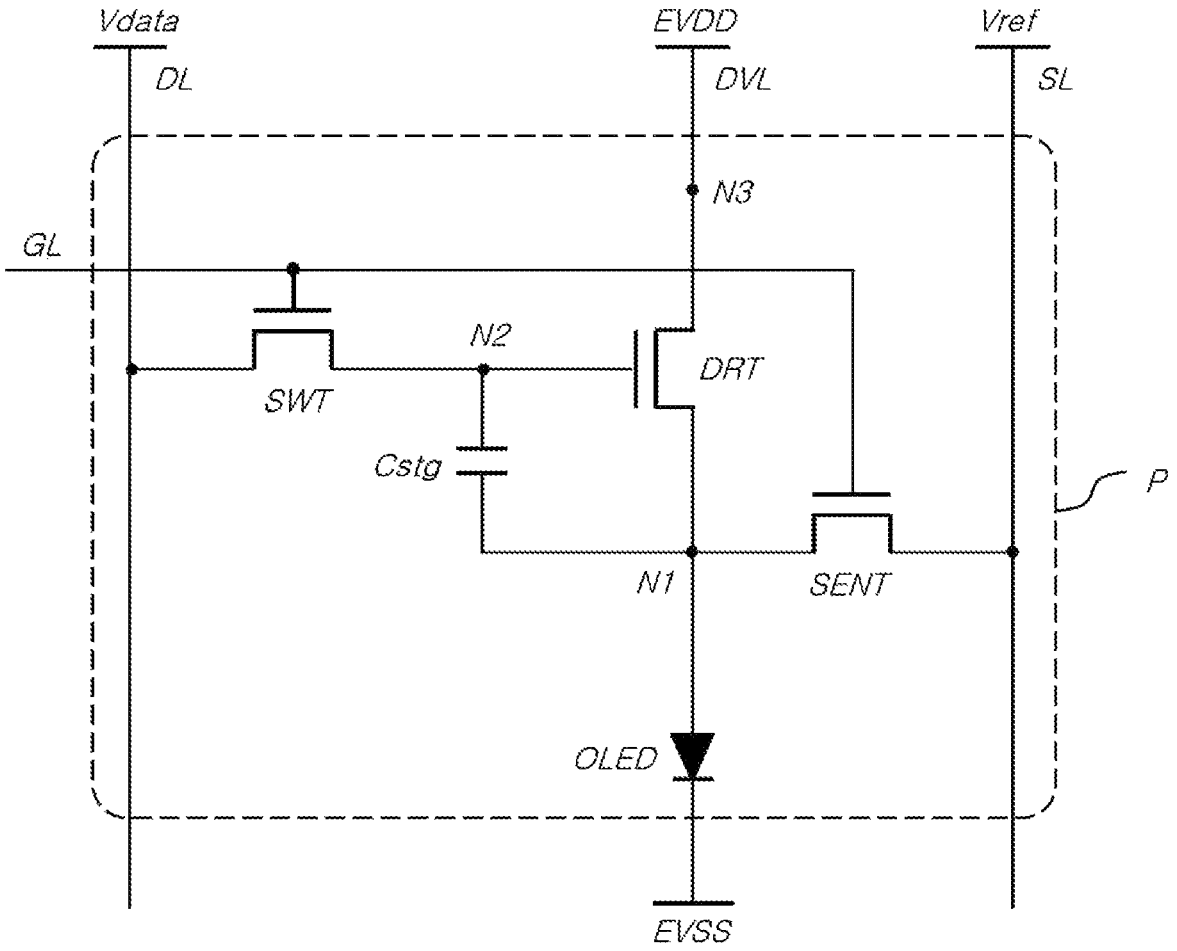
FIG. 2 illustrates a structure of each pixel of FIG. 1.

FIG. 2 illustrates a structure of each pixel of FIG. 1.

Referring to FIG. 2, each pixel P may comprise an organic light emitting diode OLED, a driving transistor DRT, a switching transistor SWT, a sensing transistor SENT, and a storage capacitor Cstg.

An organic light emitting diode OLED may consist of an anode electrode, an organic layer, and a cathode electrode. The organic light emitting diode OLED emits light by connecting the anode electrode with driving voltage EVDD and the cathode electrode with base voltage EVSS according to the control of the driving transistor DRT.

The driving transistor DRT may control the brightness of the organic light emitting diode OLED by controlling driving current supplied to the organic light emitting diode OLED.

A first node N1 of the driving transistor DRT may be electrically connected with the anode electrode of the organic light emitting diode OLED and may be a source node or a drain node. A second node N2 of the driving transistor DRT may be electrically connected with a source node or a drain node of the switching transistor SWT and may be a gate node. A third node N3 of the driving transistor DRT may be electrically connected with a driving voltage line DVL through which the driving voltage EVDD is supplied and may be a drain node or a source node.

The switching transistor SWT is electrically connected between the data line DL and the second node N2 of the driving transistor DRT and may be turned on by receiving a scan signal through the gate line GL.

When the switching transistor SWT is turned on, data voltage supplied through the data line DL is transmitted to the second node N2 of the driving transistor DRT.

The storage capacitor Cstg may be electrically connected between the first node N1 and the second node N2 of the driving transistor DRT.

The storage capacitor Cstg may be a parasitic capacitor existing between the first node N1 and the second node N2 of the driving transistor DRT or an external capacitor intentionally disposed in the outside of the driving transistor DRT.

The sensing transistor SENT may electrically connect the first node N1 of the driving transistor DRT and a sensing line SL for supplying reference voltage Vref to the first node N1 and sensing the electrical characteristic value such as voltage of the first node N1.

When the voltage of the first node N1 is sensed, the threshold voltage and the mobility of the driving transistor DRT may be figured out. In addition, when the voltage of the first node N1 is sensed, the degree of deterioration of the organic light emitting diode OLED such as parasitic capacitance of the organic light emitting diode OLED may be figured out.

The pixel sensing circuit (see 134 in FIG. 1) described referring to FIG. 1 may sense the voltage of the first node N1 shown in FIG. 2 and transmit the same to the driving control circuit 140. In addition, the driving control circuit 140 may analyze the voltage of the first node N1 and figure out the characteristics of each pixel P.

Figure 3:
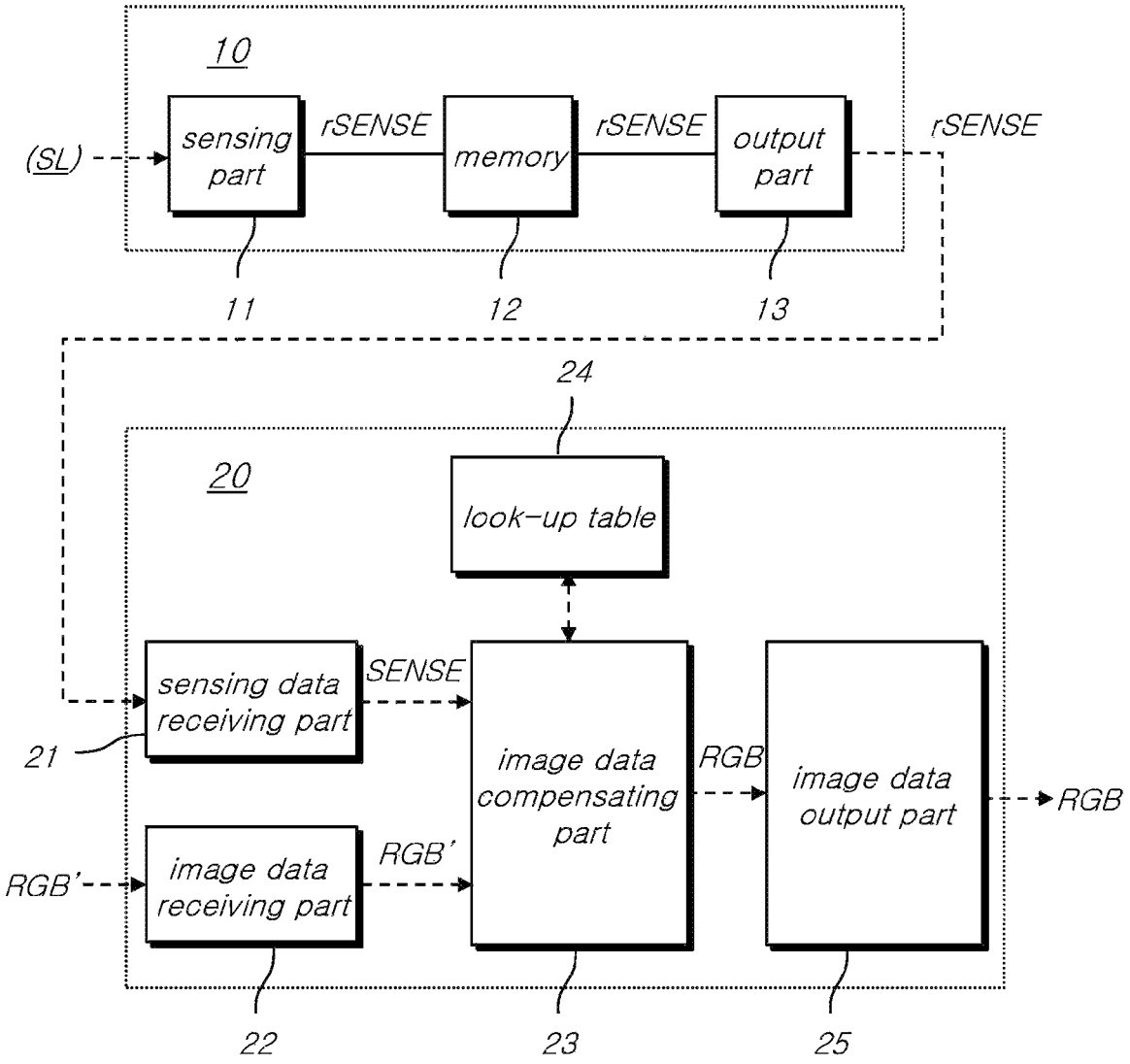
FIG. 3 is a block diagram of an example of a pixel sensing circuit and a driving control circuit.

FIG. 3 is a block diagram of an example of a pixel sensing circuit and a driving control circuit.

Referring to FIG. 3, the pixel sensing circuit 10 may comprise a sensing part 11, a memory 12, and an output part 13. Further, the driving control circuit 20 may comprise a sensing data receiving part 21, an image data receiving part 22, an image data compensating part 23, a look-up table, and an image data output part 25.

In the pixel sensing circuit 10, the sensing part 11 may sense a pixel through a sensing line SL and store the sensed raw sensing data rSENSE in the memory 12. The output part 13 may transmit the raw sensing data rSENSE stored in the memory 12 to the driving control circuit 20.

In the driving control circuit 20, the sensing data receiving part 21 receives the raw sensing data rSENSE and the image data receiving part 22 receives original image data RGB' from an external device, for example, a video control device.

In the driving control circuit 20, the image data compensating part 23 may figure out the characteristic value of each pixel using sensing data with regard to each pixel and generate image data RGB by compensating the original image data RGB' in response to the characteristic value of each pixel.

By the way, in the driving control circuit 20, the sensing data receiving part 21 receives raw sensing data rSENSE from the pixel sensing circuit 10, therefore, the sensing data receiving part 21 also performs conversion of raw sensing data rSENSE into valid sensing data SENS that can be used in the image data compensating part 23. Raw sensing data may contain noise data or unsuitable data. When such noise data or unsuitable data is used as it is in the image data compensating part 23, the quality of image data generated in the image data compensating part 23 may be worse. Therefore, the sensing data receiving part 21 generates valid sensing data SENSE suitable for the image data compensating part 23 by processing or selecting raw sensing data rSENSE.

The image data compensating part 23 may generate image data RGB to be transmitted to the data driving circuit (see 132 in FIG. 1) by applying such valid sensing data to the look-up table 24 to check a compensation value to be applied to each pixel and applying this compensation value to the original image data RGB'. The image data output part 25 may transmit such image data RGB to the data driving circuit (see 132 in FIG. 1).

Meanwhile, in the pixel sensing circuit 10, the data transmission rate indicating the number of data—raw sensing data rSENSE in FIG. 3—that the output part 13 transmits every unit time may be lower than the sensing rate indicating the number of raw sensing data rSENSE generated every unit time in the sensing part 11. Accordingly, even though the sensing part 11 senses pixels at high speed, the output 13 cannot transmit raw sensing data rSENSE at high speed, therefore, the rate that the driving control circuit 20 receives raw sensing data rSENSE is limited to the data transmission rate of the output part 13.

On the contrary, when the data transmission rate is higher than the sensing rate, the transmission rate of sensing data is faster than the rate of generating raw sensing data. Accordingly, there is a problem that part of raw sensing data rSENSE may be doubly transmitted.

In addition, since the pixel sensing circuit 10 transmits all the sensed raw sensing data rSENSE regardless of the necessity of other device that receives raw sensing data, for example, the driving control circuit 20, there is a problem that the operation load of other device increases.

As an example, even when the driving control circuit 20 may only need data having the highest value or the largest value among sensed data, the pixel sensing circuit 10 transmits all the raw sensing data rSENSE and the driving control circuit 20 selects necessary data from the raw sensing data rSENSE that the sensing data receiving part 21 receives. Accordingly, the data transmission load increases and the operation load of the driving control circuit 20 increases due to the data selection. In addition, since the pixel sensing circuit 10 transmits raw sensing data rSENSE as it is sensed, the sensing data receiving part 21 of the driving control circuit 20 has a load of data post-processing to remove noises included in the received raw sensing data rSENSE.

To solve these problems, an embodiment of the present disclosure provides technology that the pixel sensing circuit processes raw sensing data to generate valid sensing data and transmits the valid sensing data to the driving control circuit.

Figure 4:
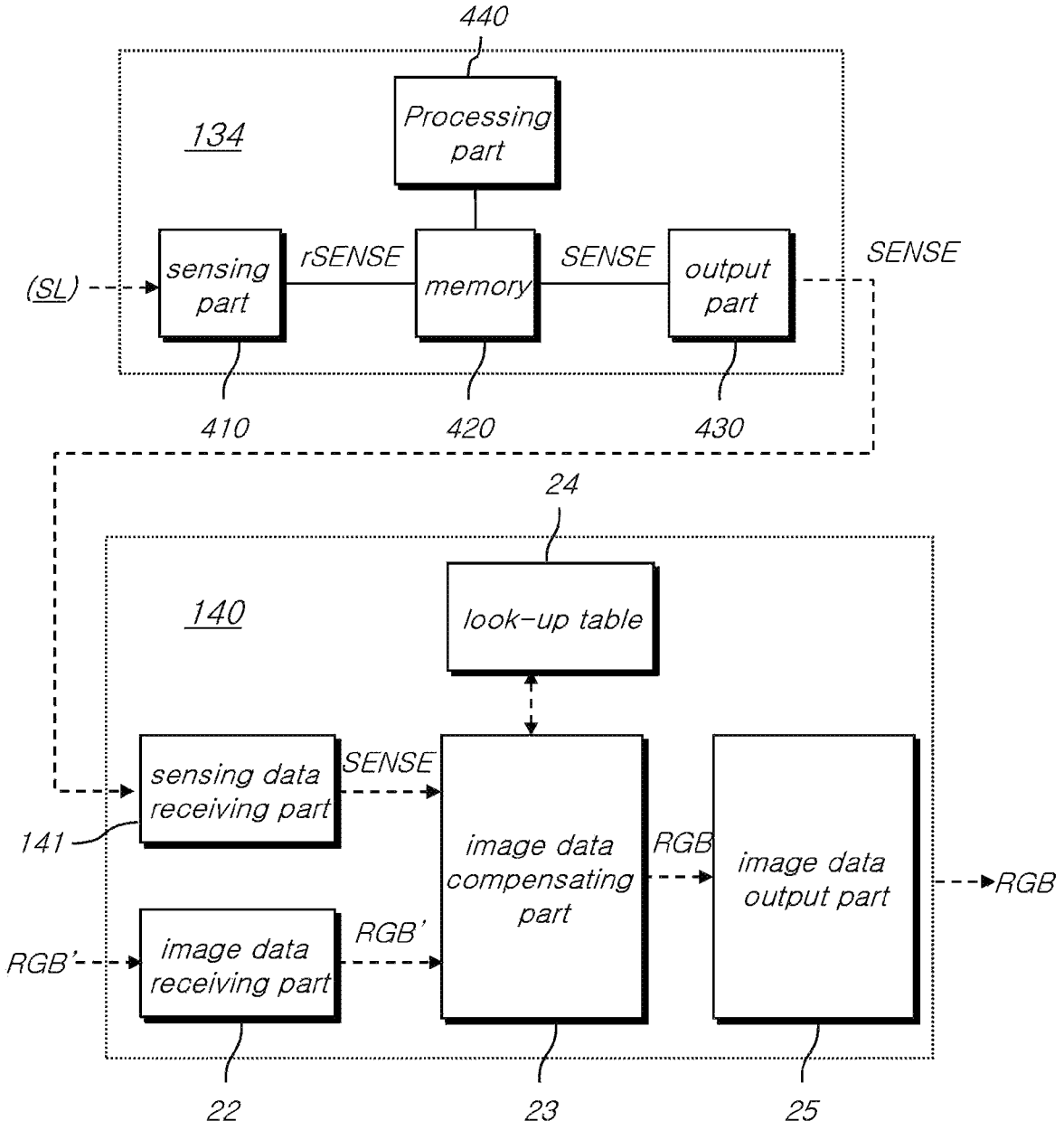
FIG. 4 is a block diagram of the inside of a pixel sensing circuit and a driving control circuit according to an embodiment of the present disclosure.

FIG. 4 is a block diagram of the inside of a pixel sensing circuit and a driving control circuit according to an embodiment of the present disclosure.

Referring to FIG. 4, the pixel sensing circuit 134 may comprise a sensing part 410, a memory 420, an output part 430, and a processing part 440 and the driving control circuit 140 may comprise a sensing data receiving part 141, an image data receiving part 22, an image data compensating part 23, a look-up table 24, and an image data output part 25.

In the pixel sensing circuit 134, the sensing part 410 senses an electrical characteristic value of a pixel, for example, voltage or current of the first node N1 in FIG. 2 through a sensing line SL. The sensing part 410 may receive analog electrical signals through a sensing line SL and include an analog-digital converter ADC to convert such analog electrical signals into digital data. The sensing part 410 may generate raw sensing data rSENSE, which is digital data, by the analog-digital converter and store the same in the memory 420.

In the pixel sensing circuit 134, the processing part 440 may read the raw sensing data rSENSE stored in the memory 420, processes the same to generate valid sensing data SENSE. Here, the number of generated valid sensing data SENSE may be smaller than the number of raw sensing data rSENSE. When valid sensing data SENSE is generated by filtering noises or removing part of data from raw sensing data rSENSE, the number of valid sensing data SENSE may be smaller than the number of raw sensing data rSENSE as described above.

Depending on an embodiment, the number of valid sensing data SENSE may be larger than the number of raw sensing data rSENSE. When the processing part 440 analyzes raw sensing data rSENSE and derives more detailed information therefrom, the number of valid sensing data SENSE may be larger than the number of raw sensing data rSENSE.

As an example of the data post-processing, the processing part 440 may generate valid sensing data SENSE by filtering raw sensing data rSENSE. The processing part 440 may generate valid sensing data SENSE by applying the moving average method to raw sensing data rSENSE. Or, the processing part 440 may generate valid sensing data SENSE by filtering only required data from raw sensing data rSENSE using the low-band filtering, mid-band filtering, or high-band filtering.

The processing part 440 may store again the generated valid sensing data SENSE in the memory 420 and the output part 430 may transmit the valid sensing data SENSE stored in the memory 420 to other devices such as the driving control circuit 140.

Meanwhile, the sensing part 410 may sense an electrical characteristic value of a pixel at a first rate. For example, the sensing part 410 may sense an electrical characteristic value of a pixel at 10 MHz of rate. When all the sensed signals are converted into raw sensing data rSENSE, the raw sensing data rSENSE may be stored in the memory 420 at 10 MHz of rate.

In addition, the processing part 440 may perform the post-processing to raw sensing data rSENSE and generate valid sensing data SENSE that can be transmitted at a second rate. Here, the second rate means the number of valid sensing data SENSE transmitted every unit time. The output part 430 may transmit such valid sensing data SENSE at the second rate.

Here, the second rate may be slower than the first rate. In this case, the pixel sensing circuit 134 may perform the post-processing of raw sensing data rSENSE sensed at the first rate by the sensing part 410 and generate valid sensing data SENSE at the second rate within the range of the transmission rate of the output part 430. In this way, the pixel sensing circuit 134 may transmit high reliable sensing data, i.e., valid sensing data SENSE to other devices such as the driving control circuit 140 while maintaining the high-speed sensing.

In addition, the driving control circuit 140, that compensates image data to be applied to a pixel according to the characteristic value of the pixel, may receive valid sensing data SENSE not raw sensing data rSENSE, so as to minimize the load due to additional operations such as noise filtering.

Specifically, referring to FIG. 4, the sensing data receiving part 141 of the driving control circuit 140 may transmit valid sensing data SENSE as it is received from the pixel sensing circuit 134 without additional operation to the image data compensating part 23. In addition, other elements 22, 23, 24, and 25 may perform the same functions as described above referring to FIG. 3.

As described regarding the embodiment shown in FIG. 4, the pixel sensing circuit 134 converts raw sensing data rSENSE into valid sensing data SENSE by its internal operation and transmits the valid sensing data SENSE to the driving control circuit 140, and this allows reducing the load of transmitting data as well as data loss and minimizing the operation load of the driving control circuit 140.

Figure 5:
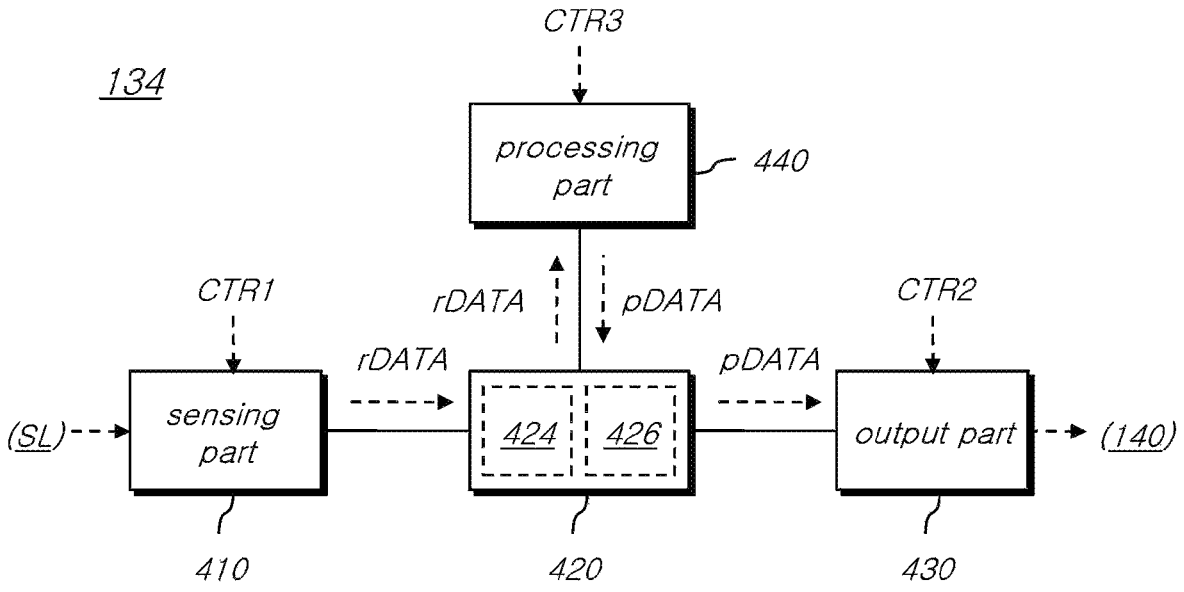
FIG. 5 illustrates the processing flow from sensing to outputting of the pixel sensing circuit shown in FIG. 4.

FIG. 5 illustrates the processing flow from sensing to outputting of the pixel sensing circuit shown in FIG. 4.

Referring to FIG. 5, the sensing part 410 may generate raw sensing data rDATA by sensing a pixel, i.e., sensing an electrical characteristic value of a pixel through a sensing line SL and store the generated raw sensing data rDATA in a first block 424 of the memory 420.

The processing part 440 may read the raw sensing data rDATA from the first block 424 and process the raw sensing data rDATA to generate valid sensing data pDATA. In addition, the processing part 440 may store the valid sensing data pDATA in a second block 426 of the memory 420.

The output par 430 may transmit the valid sensing data pDATA read from the second block 426 to the driving control circuit 140.

For example, the sensing part 410 may generate A raw sensing data rDATA every second and store the raw sensing data rDATA in the first block 424 at a rate of A per second.

The processing part 440 may perform the data post-processing with regard to the raw sensing data rDATA and generate B valid sensing data pDATA every second. In addition, the processing part 440 may store the valid sensing data pDATA in the second block 426 at a rate of B per second. The output part 430 may read valid sensing data pDATA at a rate of C per second and transmit the same to the driving control circuit 140.

In this process, the data post-processing of the processing part 140 may be similar to the data post-processing of the driving control circuit, for example, timing controller in its function. For example, when the pixel sensing circuit transmits raw sensing data as it is to the driving control circuit as in a conventional method, the driving control circuit performs a filtering to remove noises and such filtering may be similar to the data post-processing performed by the processing part 440. Accordingly, since the valid sensing data obtained by removing noises by the processing part 440 is transmitted to the driving control circuit 140, the driving control circuit 140 does not need to perform a noise filtering, therefore, the operation load of the driving control circuit 140 is reduced. In addition, since the output part 430 does not transmit noise data, but transmits valid sensing data without noises, its data transmission load is also reduced.

The sensing part 410, the processing part 440, and the output part 140 may operate by being synchronized with control signals CTR1, CTR2, and CTR3 received from the driving control circuit 140.

The sensing part 410 may generate raw sensing data rDATA according to a first cycle directed by a first control signal CTR1 received from the driving control circuit 140. The first control signal CTR1 may be a clock signal, however, it is not restricted to this. Here, the first cycle may be same as the inverse number of the sensing rate indicating the number of raw sensing data generated every unit time.

The output part 140 may transmit valid sensing data pDATA according to a second cycle directed by a second control signal CTR2 received from the driving control circuit 140. The second control signal CTR2 may be a clock signal, however, it is not restricted to this. Here, the second cycle may be same as the inverse number of the data transmission rate indicating the number of valid sensing data transmitted every unit time.

The processing part 440 may generate valid sensing data pDATA according to a third cycle directed by a third control signal CTR3 received from the driving control circuit 140. The third cycle may be longer than or equal to the first cycle. The second cycle may be longer than or equal to the third cycle.

Meanwhile, the processing part 440 may generate valid sensing data by selecting data satisfying a specific condition only, from raw sensing data generated during a certain duration.

Here, as a specific condition, a condition of the maximum value or the minimum value may be used. For example, the processing part may generate valid sensing data by selecting data having the maximum value or the minimum value from raw sensing data.

As another example for a specific condition, a condition in which the difference between a data and the data previous to it is within a certain range may be used.

For example, when the driving control circuit measures threshold voltage of a driving transistor included in a pixel, it measures threshold voltage using the sensing data at the time when there is no change of source voltage of the driving transistor. Here, the processing part may only select data, whose difference from the previous data is within a certain range—in other words, data at the time where there is no change of value—from raw sensing data to generate valid sensing data. In this case, the driving control circuit may receive necessary data only, and this allows reducing the transmission loads due to unnecessary data and the operation load due to the data selection.

More details are described below referring to FIGS. 6 and 7.

Figure 6:
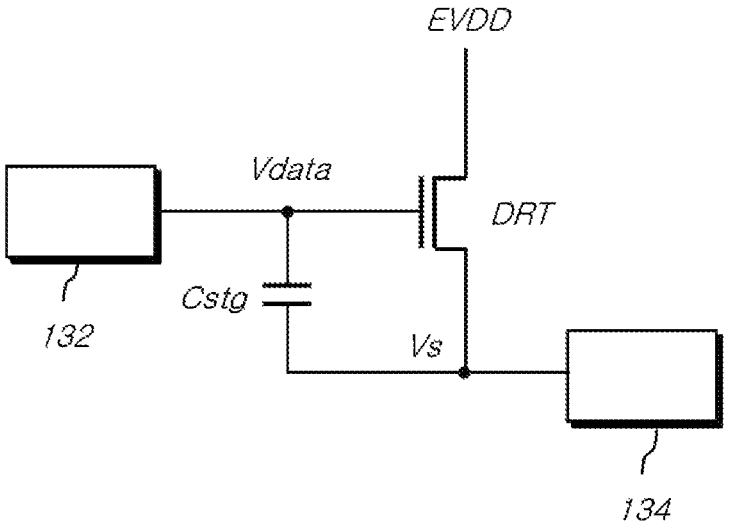
FIGS. 6 and 7 illustrate the measurement of threshold voltage of a driving transistor included in a pixel.
Figure 7:
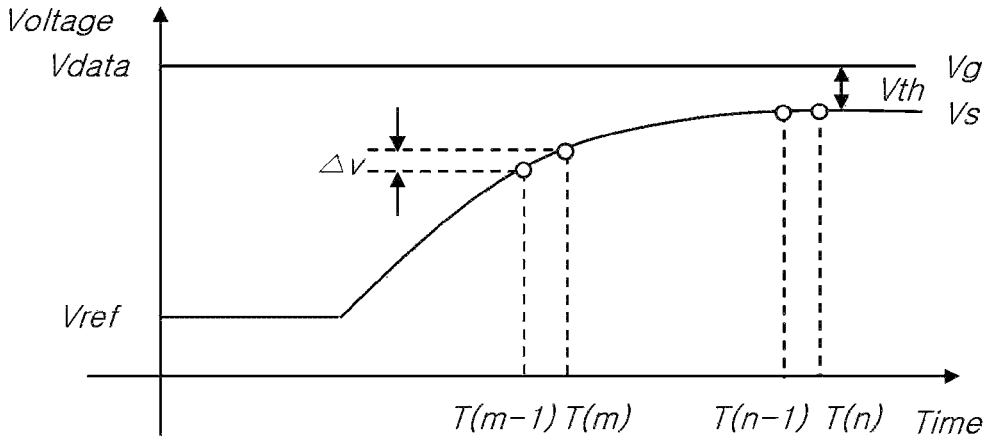

FIGS. 6 and 7 illustrate the measurement of threshold voltage of a driving transistor included in a pixel.

Referring to FIGS. 6 and 7, when sensing threshold voltage of the driving transistor DRT, source voltage Vs and gate voltage Vg of the driving transistor DRT are initialized respectively into reference voltage Vref and data voltage Vdata for sensing threshold voltage.

Subsequently, when the reference voltage is stopped being supplied and a source node of the driving transistor DRT is floated, the source voltage Vs increases. The increase of the source voltage Vs of the driving transistor DRT gradually diminishes, and then the source voltage is saturated when the gate-source voltage becomes threshold voltage Vth.

The pixel sensing circuit 134 may generate raw sensing data by sensing the source voltage Vs of the driving transistor DRT, select, from the raw sensing data, data whose difference from the previous data is within a certain range, and transmit to the driving control circuit.

The pixel sensing circuit 134 may select not only data whose difference from the previous data is practically close to 0, described as T(n) and T(n−1) in FIG. 7, but also the one whose difference from the previous data corresponds to a first difference Δv, described as T(m) and T(m−1) in FIG. 7 and transmit the same. In the latter case, even though there is some operation load for selecting data even in the driving control circuit, which receives valid sensing data, the degree of freedom for selecting data may advantageously increase in the driving control circuit.

Meanwhile, the pixel sensing circuit, for example the processing part, may generate valid sensing data by rejecting data that satisfies a specific condition among raw sensing data.

Figure 8:
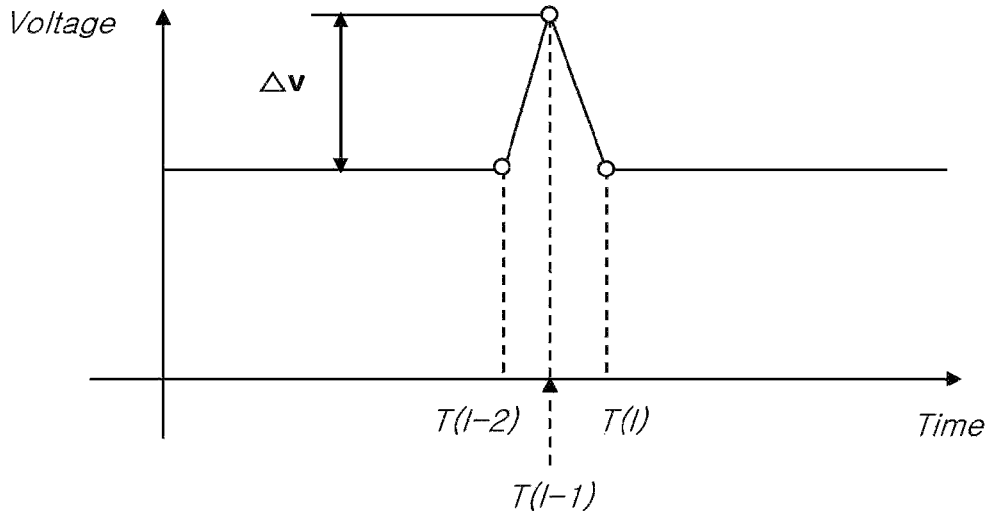
FIG. 8 illustrates that the pixel sensing circuit performs a data rejection to a noise.

FIG. 8 illustrates that the pixel sensing circuit performs a data rejection to a noise.

As shown in FIG. 8, data sensed at a first time point T(1) has a certain difference from data sensed at a previous time point, i.e., a second time point T(1-1). Further, data sensed at the second time point T(1-1) has a certain difference Δv from data sensed at a previous time point, i.e., a third time point T(1-2). The data sensed at the second time point T(1-1) is data by an one-off noise.

The pixel sensing circuit may remove one-off noises by generating valid sensing data through the data rejection for removing, from raw sensing data, data whose difference from the previous data is out of a certain range.

The pixel sensing circuit may generate valid sensing data through a post-processing of raw sensing data, and then transmit the valid sensing data to the driving control circuit. Since the pixel sensing circuit firstly processes raw sensing data in a state of raw data, the operation load of the driving control circuit due to the data post-processing may be reduced. In addition, since the pixel sensing circuit removes unnecessary data, for example, noise data by post-processing raw sensing data and selects only necessary one to generate valid sensing data, the transmission load between the pixel sensing circuit and the driving control circuit may be reduced.

The driving control circuit performs a compensation process for pixels using valid sensing data received from the pixel sensing circuit and transmits image data corrected by the compensation process to a source driver, for example, the data driving circuit. By the way, as described above, since the data post-processing such as noise filtering or data selection is performed in the pixel sensing circuit, the operation load of the driving control circuit is reduced and more operation resources may be assigned to the pixel compensation.

Figure 9:
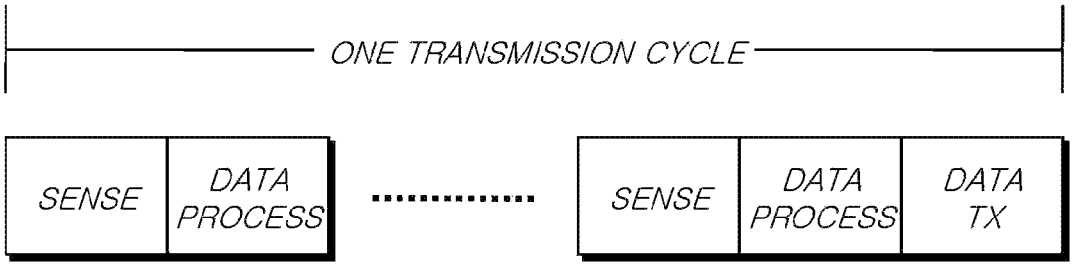
FIG. 9 is a timing diagram of a first example for an operation sequence in one transmission cycle of the pixel sensing circuit.

FIG. 9 is a timing diagram of a first example for an operation sequence in one transmission cycle of the pixel sensing circuit.

Referring to FIG. 9, the sensing part may sequentially generate N (N is a natural number) raw sensing data in one transmission cycle and the processing part may sequentially generate N valid sensing data. Here, raw sensing data and valid sensing data may be alternately generated. For example, when the sensing part generates one raw sensing data, the processing part may generate one valid sensing data using this generated one raw sensing data.

The output part may transmit a valid sensing data lastly generated during one transmission cycle, i.e., the $N^{th}$ valid sensing data to the driving control circuit.

Using such an operation sequence, the size of memory may be minimized. That is, since raw sensing data and valid sensing data may be constantly replaced by newly generated data, the size of memory where raw sensing data and valid sensing data are stored may be minimized. Further, since the output part may transmit valid sensing data as it is stored in the memory, the transmission cycle may easily be changed.

Figure 10:
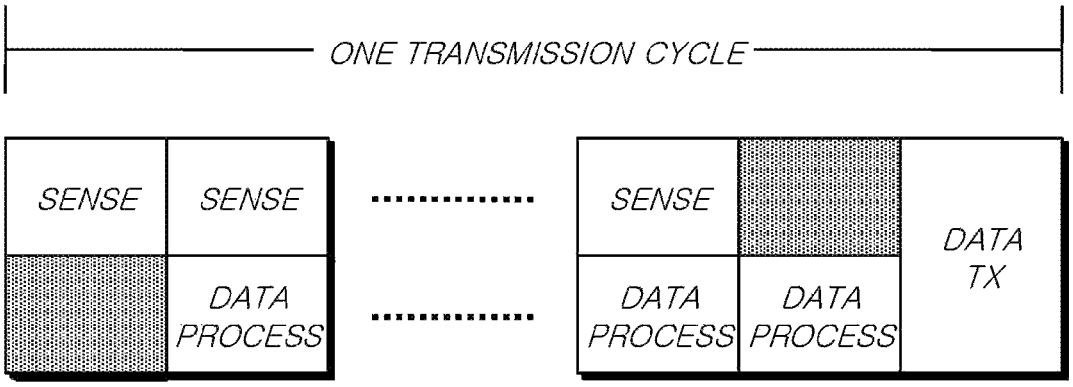
FIG. 10 is a timing diagram of a second example for an operation sequence in one transmission cycle of the pixel sensing circuit.

FIG. 10 is a timing diagram of a second example for an operation sequence in one transmission cycle of the pixel sensing circuit.

Referring to FIG. 10, the sensing part may sequentially generate N (N is a natural number) raw sensing data during one transmission cycle and the processing part may sequentially generate N valid sensing data during one transmission cycle. Differently from the sequence in FIG. 9, the generation of raw sensing data and the generation of valid sensing data may be processed in parallel. For example, while the sensing part generates raw sensing data, the processing part may generate valid sensing data. However, since at least one raw sensing data is required for generating valid sensing data, the processing part may generate valid sensing data only after at least one raw sensing data is generated. Accordingly, during one transmission cycle, the sequence of the sensing part terminates first, and then, the sequence of the processing part may terminate.

The output part may transmit a valid sensing data lastly generated during one transmission cycle, i.e., the $N^{th}$ valid sensing data to the driving control circuit.

Using such an operation sequence, the size of memory may be minimized and one transmission cycle may be shortened because of the parallel processing. That is, since raw sensing data and valid sensing data may be constantly replaced by newly generated data, the size of memory where raw sensing data and valid sensing data are stored may be minimized. Further, since the output part may transmit valid sensing data as it is stored in the memory, the transmission cycle may easily be changed. In addition, since the sensing part and the processing part operate in parallel, one transmission cycle may be shortened or during one transmission cycle, the operation time of the sensing part and the processing part may increase.

Figure 11:
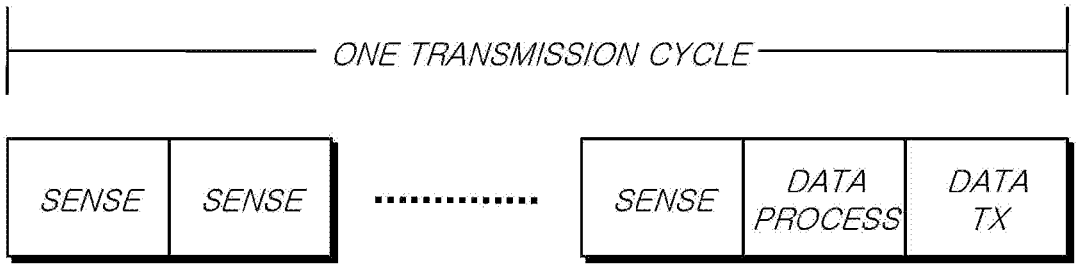
FIG. 11 is a timing diagram of a third example for an operation sequence in one transmission cycle of the pixel sensing circuit.

FIG. 11 is a timing diagram of a third example for an operation sequence in one transmission cycle of the pixel sensing circuit.

Referring to FIG. 11, the sensing part may sequentially generate M (M is a natural number, which is 2 or higher) raw sensing data during one transmission cycle and after the generation of M raw sensing data during one transmission cycle, the processing part may process M raw sensing data to generate valid sensing data. The output part may transmit the generated valid sensing data to the driving control circuit.

Using such an operation sequence, the operation load of the processing part may be minimized. The processing part may generate valid sensing data with only one operation with regard to M raw sensing data, therefore, the operation load of the processing part may be minimized.

Figure 12:
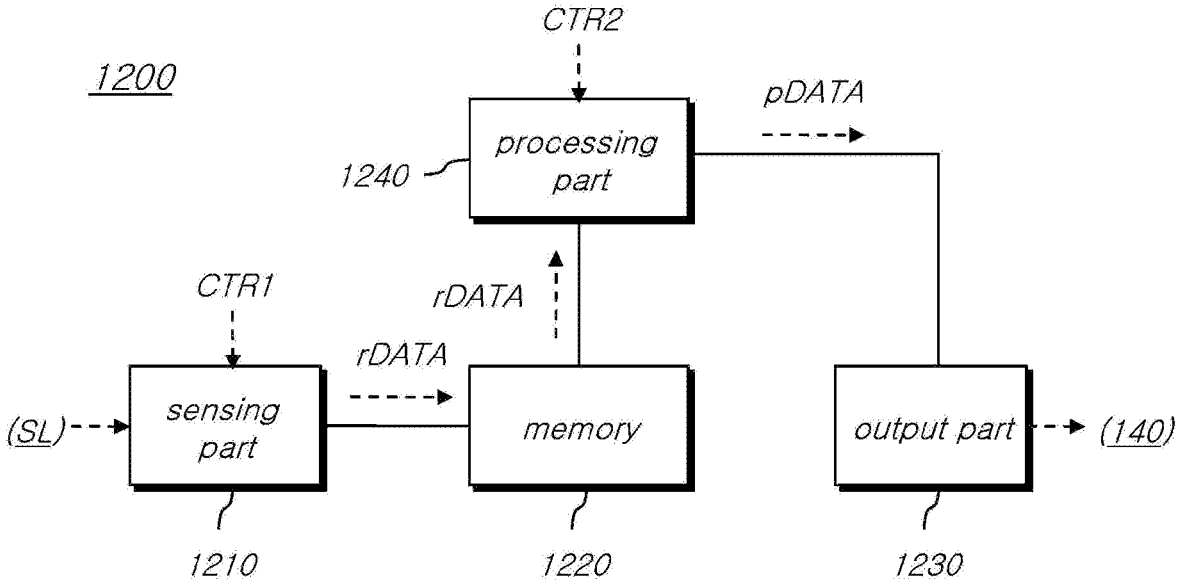
FIG. 12 is a block diagram of the inside of a pixel sensing circuit according to another embodiment of the present disclosure.

FIG. 12 is a block diagram of the inside of a pixel sensing circuit according to another embodiment of the present disclosure.

Referring to FIG. 12, the pixel sensing circuit 1200 may comprise a sensing part 1210, a memory 1220, an output part 1230, and a processing part 1240.

The sensing part 1210 senses through a sensing line SL characteristic values of pixels, for example, voltage or current of the first node N1 in FIG. 2. The sensing part 1210 may receive analog electric signals through sensing lines SL and the sensing part 1210 may comprise an analog-digital converter ADC for converting analog electric signals into digital data. The sensing part 1210 may generate raw sensing data rDATA, which is digital data, by the analog-digital converter and store the same in the memory 1220.

The processing part 1240 may read raw sensing data rDATA stored in the memory 1220, processes the raw sensing data rDATA, and generate valid sensing data pDATA.

The processing part 1240 may transmit the generated valid sensing data pDATA to the output part 1230.

The output part 1230 may transmit the valid sensing data pDATA directly received from the processing part 1240 to other devices such as the driving control circuit 140.

The sensing part 1210 may generate raw sensing data rDATA according to the first cycle directed by the first control signal CTR1 received from the driving control circuit 140.

The processing part 1240 may generate valid sensing data pDATA according to the second cycle directed by the second control signal CTR2 received from the driving control circuit 140. The output part 1230 transmits the valid sensing data pDATA directly received from the processing part 1240, therefore, may operate practically in connection with the second control signal CTR2.

Figure 13:
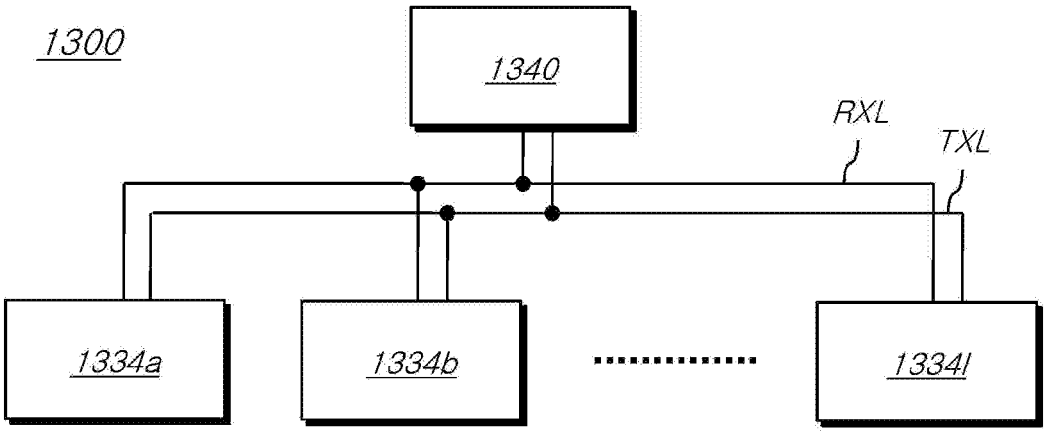
FIG. 13 is a block diagram of a panel driving device according to another embodiment of the present disclosure.

FIG. 13 is a block diagram of a panel driving device according to another embodiment of the present disclosure.

Referring to FIG. 13, the panel driving device 1300 may comprise a driving control circuit 1340 and L (L is a natural number, which is 2 or higher) pixel sensing circuits 1334*a*, 1334*b*, . . . , 1334*l*.

The driving control circuit 1340 may be connected with L pixel sensing circuits 1334*a*, 1334*b*, . . . , 1334*l* through one receiving bus line RXL and one transmission bus line TXL.

The driving control circuit 1340 may transmit control signals for the pixel sensing circuits 1334*a*, 1334*b*, . . . , 1334*l* through the receiving bus line RXL. Such control signals may comprise the aforementioned first control signal CTR1, second control signal CTR2, third control signal CTR3, etc. and according to an embodiment, the first control signal CTR1, the second control signal CTR2, and the third control signal CTR3 may transmit through a line separated from the receiving bus line RXL.

Each pixel sensing circuit 1334*a*, 1334*b*, . . . , 1334*l* may generate raw sensing data by sensing a pixel and transmit valid sensing data obtained by processing at least one raw sensing data through the one transmission bus line TXL to the driving control circuit 1340. Further, each pixel sensing circuit 1334*a*, 1334*b*, . . . , 1334*l* may sequentially transmit valid sensing data to prevent data from conflicting in the one transmission bus line TXL.

As an example, the first pixel sensing circuit 1334*a* may firstly transmit valid sensing data to the driving control circuit 1340 and the $K^{th}$ (K is a natural number of 2 or higher, which is smaller than or equal to L) pixel sensing circuit may transmit valid sending data after the $(K-1)^{th}$ pixel sensing circuit transmits valid sensing data.

The driving control circuit 1340 can check if all the L pixel sensing circuits 1334*a*, 1334*b*, . . . , 1334*l* transmit valid sensing data by comparing the predetermined number (L) of the pixel sensing circuits with the number of valid sensing data.

Meanwhile, the display device may distinguish a display time section from a blank time section and display images by driving pixels in the display time section. The L pixel sensing circuits 1334*a*, 1334*b*, . . . , 1334*l* may sense pixels in the blank time section where pixels are not driven. The L pixel sensing circuits 1334*a*, 1334*b*, . . . , 1334*l* may transmit valid sensing data in the blank time section. However, in some cases, at least one of the L pixel sensing circuits 1334*a*, 1334*b*, . . . , 1334*l* may transmit valid sensing data in the display time section where pixels are driven.

The L pixel sensing circuit 1334*a*, 1334*b*, . . . , 1334*l* may sense pixels in a same sensing time section and transmit valid sensing data respectively in time sections different from each other.

Figure 14:
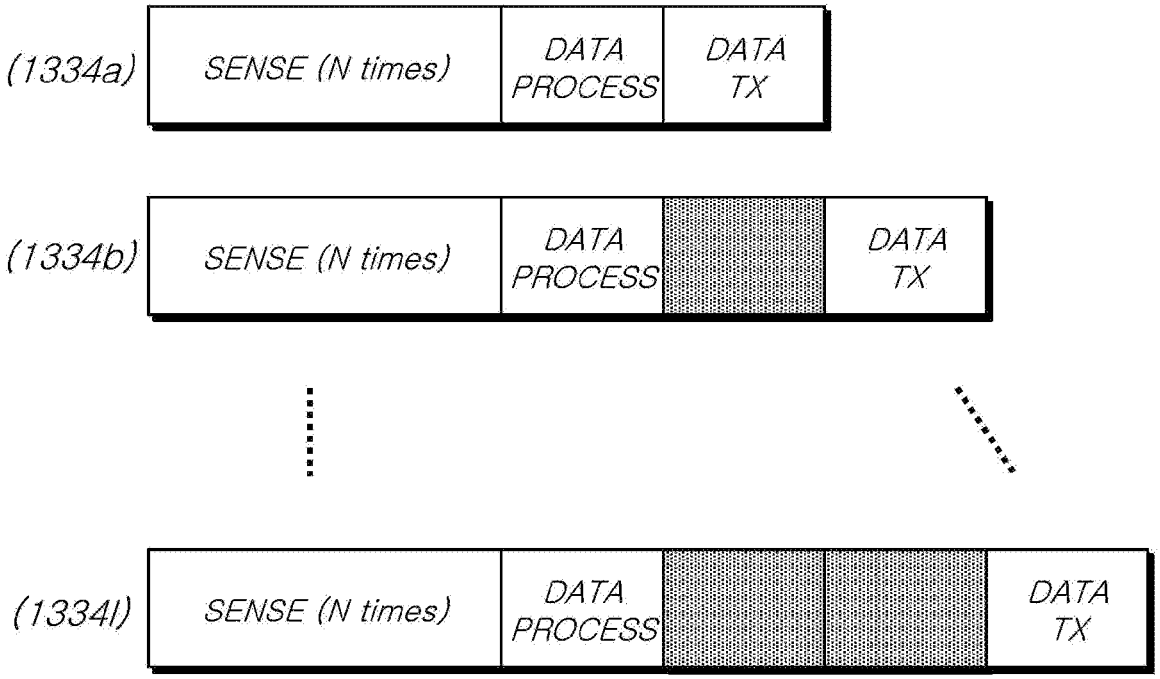
FIG. 14 is a timing diagram illustrating a sensing and transmission sequence according to another embodiment of the present disclosure.

FIG. 14 is a timing diagram illustrating a sensing and transmission sequence according to another embodiment of the present disclosure.

Referring to FIG. 14, the L pixel sensing circuit 1334*a*, 1334*b*, . . . , 1334*l* may sense a pixel N times in the same sensing time section. Further, the L pixel sensing circuit 1334*a*, 1334*b*, . . . , 1334*l* may generate valid sensing data by post-processing raw sensing data generated N times in a same time section.

Meanwhile, the L pixel sensing circuit 1334*a*, 1334*b*, . . . , 1334*l* may transmit valid sensing data respectively in time sections different from each other in order to prevent data from conflicting in the transmission bus line.

Here, the sensing time section where pixels are sensed may be included in the blank time section and a part or all of the duration when valid sensing data is generated and the duration when the valid sensing data is transmitted may be included in the display time section.

Each pixel sensing circuit 1334*a*, 1334*b*, . . . , 1334*l* may transmit valid sensing data by being synchronized with a carry signal.

Figure 15:
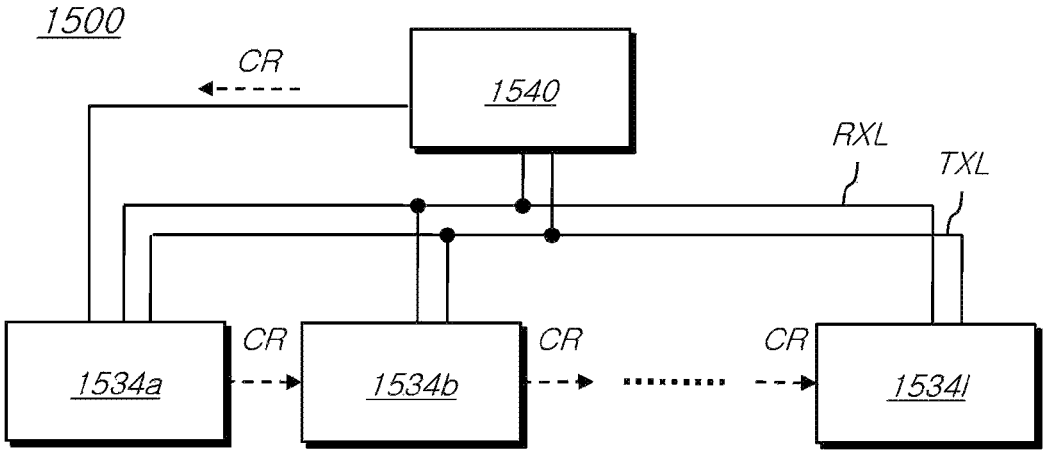
FIG. 15 is a block diagram of a panel driving device controlling the transmission timing using carry signals.

FIG. 15 is a block diagram of a panel driving device controlling the transmission timing using carry signals.

Referring to FIG. 15, the panel driving device 1500 may comprise a driving control circuit 1540 and L pixel sensing circuits 1534*a*, 1534*b*, . . . , 1534*l*.

In addition, the driving control circuit 1540 may be connected with the L pixel sensing circuit 1534*a*, 1534*b*, . . . , 1534*l* through one receiving bus line RXL and one transmission bus line TXL.

The driving control circuit 1540 may transmit control signals for the pixel sensing circuits 1534*a*, 1534*b*, . . . , 1534*l* through the receiving bus line RXL.

Further, each pixel sensing circuit 1534*a*, 1534*b*, . . . , 1534*l* may generate raw sensing data by sensing a pixel and transmit valid sensing data generated by processing at least one raw sensing data to the driving control circuit 1540 through the one transmission bus line TXL. Further, each pixel sensing circuit 1534*a*, 1534*b*, . . . , 1534*l* may sequentially transmit valid sensing data in order to prevent data from conflicting in the one transmission bus line TXL.

The transmission timing of each pixel sensing circuit 1534*a*, 1534*b*, . . . , 1534*l* may be determined by a carry signal CR.

The first pixel sensing circuit 1534*a* may receive a carry signal CR from the driving control circuit 1540 and the $K^{th}$ pixel sensing circuit may receive a carry signal CR from the $(K-1)^{th}$ pixel sensing circuit.

The first pixel sensing circuit 1534*a* may be connected with the driving control circuit 1540 through a carry signal line. The first pixel sensing circuit 1534*a* may receive a carry signal CR from the driving control circuit 1540 through this carry signal line.

The $K^{th}$ pixel sensing circuit may be connected with the $(K-1)^{th}$ pixel sensing circuit through a carry signal line. The $K^{th}$ pixel sensing circuit may receive a carry signal CR from the $(K-1)^{th}$ pixel sensing circuit through this carry signal line.

After transmitting valid sensing data by receiving a carry signal CR from the $(K-1)^{th}$ pixel sensing circuit, the $K^{th}$ pixel sensing circuit may transmit the carry signal CR to the $(K+1)^{th}$ pixel sensing circuit in order that the next pixel sensing circuit may transmit valid sensing data.

Each pixel sensing circuit 1534*a*, 1534*b*, . . . , 1534*l* transmits a carry signal CR in this order and the $L^{th}$ pixel sensing circuit 1534*l* that lastly receives the carry signal CR may transmit the carry signal CR to the driving control circuit 140. The driving control circuit 140 may check that all the pixel sensing circuits 1534*a*, 1534*b*, . . . , 1534*l* normally transmit valid sensing data by the received carry signal CR.

Meanwhile, the $L^{th}$ pixel sensing circuit 1534*l* that lastly receives the carry signal CR may not transmit the carry signal CR to the outside. Here, the driving control circuit 140 may check if all the L pixel sensing circuits 1534*a*, 1534*b*, . . . , 1534*l* transmit valid sensing data by comparing the predetermined number (L) of pixel sensing circuits with the number of valid sensing data.

As described above, the present disclosure allows increasing the utilization of data sensed at a high-speed with regard to the characteristics of pixel. Further, the present disclosure allows remedying problems of the data loss or the data transmission inefficiency due to the discrepancy between the sensing rate with regard to a pixel and the data transmission rate. Further, the present disclosure allows reducing an operation load or a data post-processing load of a device for driving pixels.

Since terms, such as "including," "comprising," and "having" mean that corresponding elements may exist unless they are specifically described to the contrary, it shall be construed that other elements can be additionally included, rather than that such elements are omitted. All technical, scientific or other terms are used consistently with the meanings as understood by a person skilled in the art unless defined to the contrary. Common terms as found in dictionaries should be interpreted in the context of the related technical writings, rather than overly ideally or impractically, unless the present disclosure expressly defines them so.

Although a preferred embodiment of the present disclosure has been described for illustrative purposes, those skilled in the art will appreciate that various modifications, additions and substitutions are possible, without departing from the scope and spirit of the embodiment as disclosed in the accompanying claims. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A pixel sensing device comprising:

a sensing part for sensing a pixel whose brightness is controlled in response to data voltage corresponding to image data to generate raw sensing data and storing said raw sensing data to a memory;

a processing part for generating valid sensing data by processing or selecting said raw sensing data read from said memory; and an output part for transmitting said valid sensing data to a driving control circuit which determines a characteristic value of said pixel using said valid sensing data with regard to said pixel and compensates said image data applied to said pixel in response to said characteristic value of the pixel, wherein said sensing part sequentially generates M (M is a natural number, which is 2 or higher) raw sensing data in one transmission cycle and said processing part generates said valid sensing data by processing or selecting said M raw sensing data in said one transmission cycle.

2. The pixel sensing device of claim 1, wherein said driving control circuit figures out, as a characteristic value of said pixel, the threshold voltage or the mobility of a driving transistor included in said pixel using said valid sensing data.

3. The pixel sensing device of claim 1, wherein said sensing part generates said raw sensing data by sensing current of an organic light emitting diode included in said pixel, current of a driving transistor included in said pixel, or voltage at the contact point of said organic light emitting diode and said driving transistor.

4. The pixel sensing device of claim 1, wherein the number of raw sensing data generated every unit time by said sensing part is larger than the number of valid sensing data transmitted every unit time by said output part.

5. The pixel sensing device of claim 1, wherein said sensing part stores said raw sensing data in a first block of said memory, said processing part stores said valid sensing data in a second block of said memory, and said output part transmits said valid sensing data read from said second block to said driving control circuit.

6. The pixel sensing device of claim 1, wherein said output part directly receives said valid sensing data from said processing part and transmits said valid sensing data to said driving control circuit.

7. A pixel sensing device comprising:

a sensing part for sensing a pixel whose brightness is controlled in response to data voltage corresponding to image data to generate raw sensing data and storing said raw sensing data to a memory;

a processing part for generating valid sensing data by processing or selecting said raw sensing data read from said memory; and an output part for transmitting said valid sensing data to a driving control circuit which determines a characteristic value of said pixel using said valid sensing data with regard to said pixel and compensates said image data applied to said pixel in response to said characteristic value of the pixel, wherein said sensing part generates said raw sensing data according to a first cycle, said output part transmits said valid sensing data according to a second cycle, and said processing part generates said valid sensing data according to a third cycle, wherein said third cycle is longer than or equal to said first cycle and said second cycle is longer than or equal to said third cycle.

8. A pixel sensing device comprising:

a sensing part for sensing a pixel whose brightness is controlled in response to data voltage corresponding to image data to generate raw sensing data and storing said raw sensing data to a memory;

a processing part for generating valid sensing data by processing or selecting said raw sensing data read from said memory; and an output part for transmitting said valid sensing data to a driving control circuit which determines a characteristic value of said pixel using said valid sensing data with regard to said pixel and compensates said image data applied to said pixel in response to said characteristic value of the pixel, wherein said sensing part sequentially generates N (N is a natural number) raw sensing data in one transmission cycle, said processing part sequentially generates N valid sensing data in said one transmission cycle, and said output part transmits the $N^{th}$ valid sensing data to said driving control circuit in said one transmission cycle.

9. A panel driving device comprising:

L (L is a natural number, which is 2 or higher) pixel sensing circuits, each for sensing a pixel to generate raw sensing data and transmitting valid sensing data generated by processing or selecting said raw sensing data; and a driving control circuit, connected with said L pixel sensing circuits through one bus line, receiving said valid sensing data sequentially transmitted from each pixel sensing circuit through said one bus line, determining a characteristic value of said pixel using said valid sensing data, and compensating image data applied to said pixel in response to said characteristic value, wherein said L pixel sensing circuits sense pixels in a same sensing time section and transmit said valid sensing data respectively in time sections different from each other.

10. A panel driving device comprising:

L (L is a natural number, which is 2 or higher) pixel sensing circuits, each for sensing a pixel to generate raw sensing data and transmitting valid sensing data generated by processing or selecting said raw sensing data; and a driving control circuit, connected with said L pixel sensing circuits through one bus line, receiving said valid sensing data sequentially transmitted from each pixel sensing circuit through said one bus line, determining a characteristic value of said pixel using said valid sensing data, and compensating image data applied to said pixel in response to said characteristic value, wherein said L pixel sensing circuits transmit said valid sensing data by being synchronized with a carry signal, a first pixel sensing circuit receives said carry signal from said driving control circuit, and a $K^{th}$ (K is a natural number of 2 or higher, which is smaller than or equal to L) pixel sensing circuit receives said carry signal from a $(K-1)^{th}$ pixel sensing circuit.

11. The panel driving device of claim 10, wherein said driving control circuit checks if all said L pixel sensing circuits transmit said valid sensing data by comparing the predetermined number (L) of said pixel sensing circuits with the number of said valid sensing data.

12. The panel driving device of claim 10, wherein said L pixel sensing circuits sense said pixels in a blank time section where said pixels are not driven and at least one of said L pixel sensing circuits transmits said valid sensing data in a display time section where said pixels are driven.

* * * * *